US011450475B2

(12) United States Patent
Suzuki et al.

(10) Patent No.: US 11,450,475 B2
(45) Date of Patent: Sep. 20, 2022

(54) COIL COMPONENT AND MANUFACTURING METHOD THEREFOR

(71) Applicant: TDK Corporation, Tokyo (JP)

(72) Inventors: Masanori Suzuki, Tokyo (JP); Yuuichi Kawaguchi, Tokyo (JP); Naoaki Fujii, Tokyo (JP); Tomonaga Nishikawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 394 days.

(21) Appl. No.: 16/642,773

(22) PCT Filed: Aug. 10, 2018

(86) PCT No.: PCT/JP2018/030051
§ 371 (c)(1),
(2) Date: Feb. 27, 2020

(87) PCT Pub. No.: WO2019/044459
PCT Pub. Date: Mar. 7, 2019

(65) Prior Publication Data

US 2021/0005377 A1 Jan. 7, 2021

(30) Foreign Application Priority Data

Aug. 28, 2017 (JP) ..... JP2017-162945

(51) Int. Cl.
*H01F 27/32* (2006.01)
*H01F 27/28* (2006.01)
(Continued)

(52) U.S. Cl.
CPC ..... *H01F 27/2804* (2013.01); *H01F 27/24* (2013.01); *H01F 27/324* (2013.01);
(Continued)

(58) Field of Classification Search
CPC ..... H01F 17/0013; H01F 17/02; H01F 27/24; H01F 27/2804; H01F 27/324;
(Continued)

(56) References Cited

U.S. PATENT DOCUMENTS 6,181,232 B1 * 1/2001 Kitamura ..... H01F 17/04 336/200
6,768,409 B2 * 7/2004 Inoue ..... H01F 41/046 336/200
(Continued)

FOREIGN PATENT DOCUMENTS

JP 2003-133135 A 5/2003

OTHER PUBLICATIONS

International Search Report issued in corresponding International Patent Application No. PCT/JP2018/030051, dated Oct. 23, 2018, with English translation.

*Primary Examiner* — Matthew V Nguyen
(74) *Attorney, Agent, or Firm* — McDermott Will & Emery LLP

(57) ABSTRACT

A coil component includes: a first magnetic resin layer in a lower area; a second magnetic resin layer in an inner diameter area surrounded by a coil pattern, an outer peripheral area that surrounds the coil pattern, and an upper area; and an insulating gap layer between the first and second magnetic resin layers. A part of the insulating gap layer positioned between the first magnetic resin layer and a part of the second magnetic resin layer positioned in the inner diameter area is curved in the axial direction. A magnetic substrate need not be used. The insulating gap layer is provided, allowing the insulating gap layer to function as a magnetic gap. The insulating gap layer is curved in the axial direction, so that a contact area between the insulating gap
(Continued)

layer and the first and second magnetic resin layers are increased to enhance adhesion therebetween.

7 Claims, 9 Drawing Sheets

(51) Int. Cl.
*H01F 27/24* (2006.01)
*H01F 41/04* (2006.01)
*H01F 41/12* (2006.01)

(52) U.S. Cl.
CPC ..... *H01F 41/041* (2013.01); *H01F 41/125* (2013.01); *H01F 2027/2809* (2013.01)

(58) Field of Classification Search
CPC ..... H01F 2017/048; H01F 2027/2809; H01F 41/041; H01F 41/042; H01F 41/046; H01F 41/125
See application file for complete search history.

(56) References Cited

U.S. PATENT DOCUMENTS

| | | | | |
|---|---|---|---|---|
| 7,821,371 | B2 * | 10/2010 | Inoue | H01F 17/0006 336/200 |
| 2003/0076211 | A1 | 4/2003 | Matsuta et al. | |
| 2014/0285307 | A1 * | 9/2014 | Ishida | H01F 17/04 336/200 |
| 2015/0077209 | A1 * | 3/2015 | Fujii | H01F 17/0006 336/200 |
| 2017/0140864 | A1 * | 5/2017 | Arai | H01F 27/245 |
| 2018/0330864 | A1 * | 11/2018 | Kajiyama | H01F 3/14 |
| 2019/0088413 | A1 * | 3/2019 | Kawaguchi | H01F 27/323 |
| 2019/0311831 | A1 * | 10/2019 | Yeo | H01F 41/042 |

* cited by examiner

COIL COMPONENT AND MANUFACTURING METHOD THEREFOR

CROSS REFERENCE

This application is the U.S. National Phase under 35 US.C. § 371 of International Application No. PCT/JP2018/030051, filed on Aug. 10, 2018, which claims the benefit of Japanese Application No. 2017-162945, filed on Aug. 28, 2017, the entire contents of each are hereby incorporated by reference.

TECHNICAL FIELD

The present invention relates to a coil component and a manufacturing method therefor and, more particularly, to a coil component having a magnetic resin layer embedding therein a coil pattern and a manufacturing method therefor.

BACKGROUND ART

As a coil component in which a coil pattern is embedded in a magnetic resin layer, the coil component disclosed in Patent Document 1 is known. In the coil component described in Patent Document 1, a coil pattern is sandwiched between two magnetic substrates, and an inner diameter area and an outer peripheral area of the coil pattern are embedded in a magnetic resin layer. Further, a non-magnetic adhesive layer is interposed between the magnetic resin layer and one magnetic substrate, and the adhesive layer functions as a magnetic gap.

CITATION LIST

Patent Document

[Patent Document 1] JP 2003-133135A

SUMMARY OF INVENTION

Problem to be Solved by the Invention

To reduce the height of the coil component described in Patent Document 1, the two magnetic substrates need to be thinner. However, when the magnetic substrate is made thinner, crack or chipping is likely to occur to reduce product reliability. Further, using two magnetic substrates makes it difficult to reduce material cost.

It is therefore an object of the present invention to provide a coil component not requiring the magnetic substrate and a manufacturing method therefor.

Means for Solving the Problem

A coil component according to the present invention includes: a coil pattern; a first magnetic resin layer provided in a lower area covering the coil pattern from one side in a coil axis direction; a second magnetic resin layer provided in an inner diameter area surrounded by the coil pattern, an outer peripheral area that surrounds the coil pattern, and an upper area that covers the coil pattern from the other side in the coil axis direction; and an insulating gap layer provided between the first and second magnetic resin layers. A part of the insulating gap layer that is positioned between the first magnetic resin layer and a part of the second magnetic resin layer that is positioned in the inner diameter area is curved in the axial direction.

According to the present invention, the coil pattern is covered with the first and second magnetic resin layers, so that a magnetic substrate need not be used. Further, the insulating gap layer is provided between the first and second magnetic resin layers, allowing the insulating gap layer to function as a magnetic gap. In addition, the insulating gap layer is curved in the axial direction, so that a contact area between the insulating gap layer and the first and second magnetic resin layers is increased to enhance adhesion therebetween.

In the present invention, the first and second magnetic resin layers may be made of the same material. Thus, material cost can be reduced.

In the present invention, assuming that the maximum displacement amount in the axial direction with respect to the flat part of the insulating gap layer is L and that the diameter of the inner diameter area of the second magnetic resin layer is B, the value of L/B is preferably in the range of 0.001 to 0.5 and, more preferably in the range of 0.01 to 0.2.

A coil component manufacturing method according to the present invention includes the steps of: forming a coil pattern on the surface of an insulating gap layer supported by a carrier plate; forming a second magnetic resin layer in an inner diameter area surrounded by the coil pattern, an outer peripheral area that surrounds the coil pattern, and an upper area that covers the coil pattern from one side in a coil axis direction; forming a first magnetic resin layer on the back surface of the insulting gap layer after peeling off the carrier plate; and pressing the first and second magnetic resin layers to curve, in the axial direction, apart of the insulating gap layer that is positioned between the first magnetic resin layer and a part of the second magnetic resin layer that is positioned in the inner diameter area.

According to the present invention, the carrier plate supporting the insulating gap layer is used, so that the first and second magnetic resin layers can be formed respectively on their corresponding surfaces of the insulating gap layer.

In the present invention, the step of forming the first and second magnetic resin layers may be performed by applying a semi-cured magnetic resin material. Thus, it is possible to charge the magnetic resin layer without gaps and to eliminate the need of using another carrier plate for supporting the magnetic resin layer.

Advantageous Effects of the Invention

As described above, according to the present invention, there can be provided a coil component not requiring the magnetic substrate and a manufacturing method therefor.

MODE FOR CARRYING OUT THE INVENTION

Preferred embodiments of the present invention will be explained below in detail with reference to the accompanying drawings.

Figure 1:
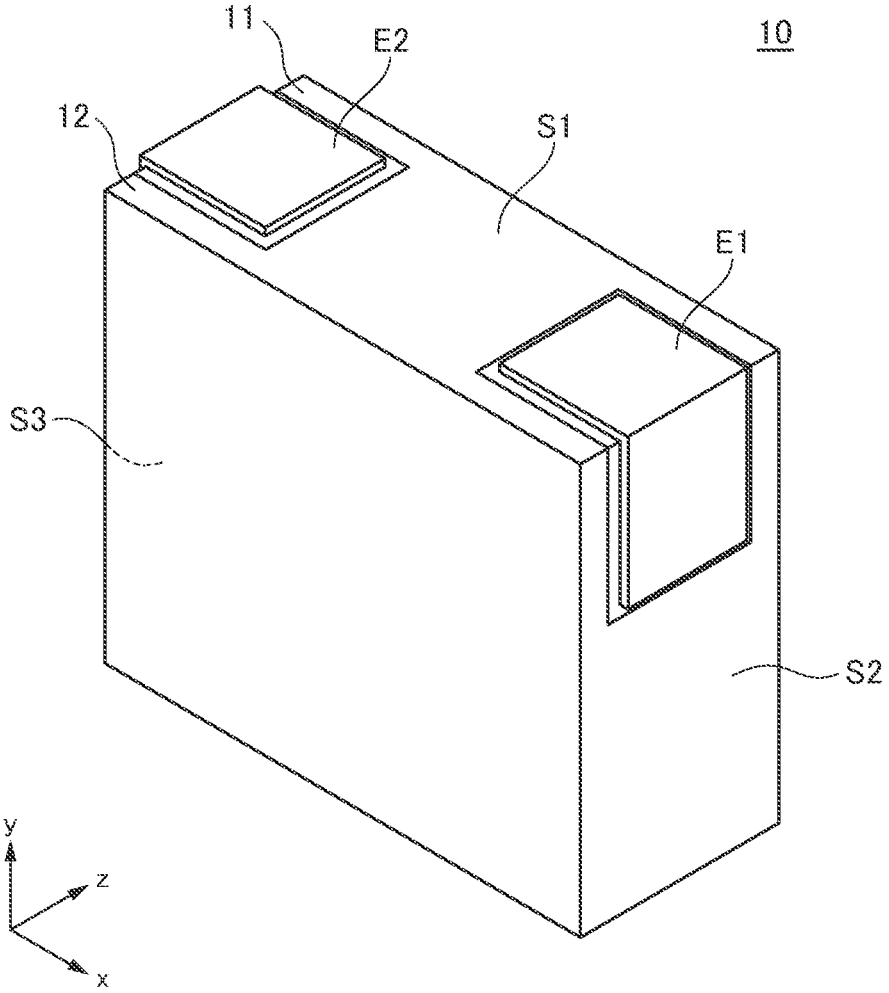
FIG. 1 is a perspective view illustrating the outer appearance of a coil component 10 according to a preferred embodiment of the present invention.

FIG. 1 is a perspective view illustrating the outer appearance of a coil component 10 according to a preferred embodiment of the present invention.

The coil component 10 according to the present embodiment is a surface-mount type chip component suitably used as an inductor for a power supply circuit and has first and second magnetic resin layers 11 and 12 as illustrated in FIG. 1. A coil pattern to be described later is embedded in the first and second magnetic resin layers 11 and 12. One end of the coil pattern is connected to a first external terminal E1, and the other end thereof is connected to a second external terminal E2. The coil component according to the present invention may not necessarily be the surface-mount type chip component but may be a chip component of a type embedded in a circuit board.

The first and second magnetic resin layers 11 and 12 are each a composite member made of resin containing magnetic particles, such as ferrite powder or metal magnetic particles and constitute a magnetic path for magnetic flux generated by making current flow in the coil pattern. When metal magnetic particles are used as the magnetic particles, a permalloy-based material is preferably used. As the resin, semi-cured epoxy resin of liquid or powder is preferably used. The first and second magnetic resin layers 11 and 12 may be made of the same material or different materials. In the former case, the material cost can be reduced.

Unlike common laminated coil components, the coil component 10 according to the present embodiment is vertically mounted such that the z-direction which is the lamination direction is parallel to a circuit board. Specifically, a surface constituting the xz plane is used as amounting surface S1. On the mounting surface S1, the first and second external terminals E1 and E2 are provided. The first external terminal E1 is continuously formed from the mounting surface S1 to a side surface S2 constituting the yz plane, and the second external terminal E2 is continuously formed from the mounting surface S1 to a side surface S3 constituting the yz plane.

Figure 2:
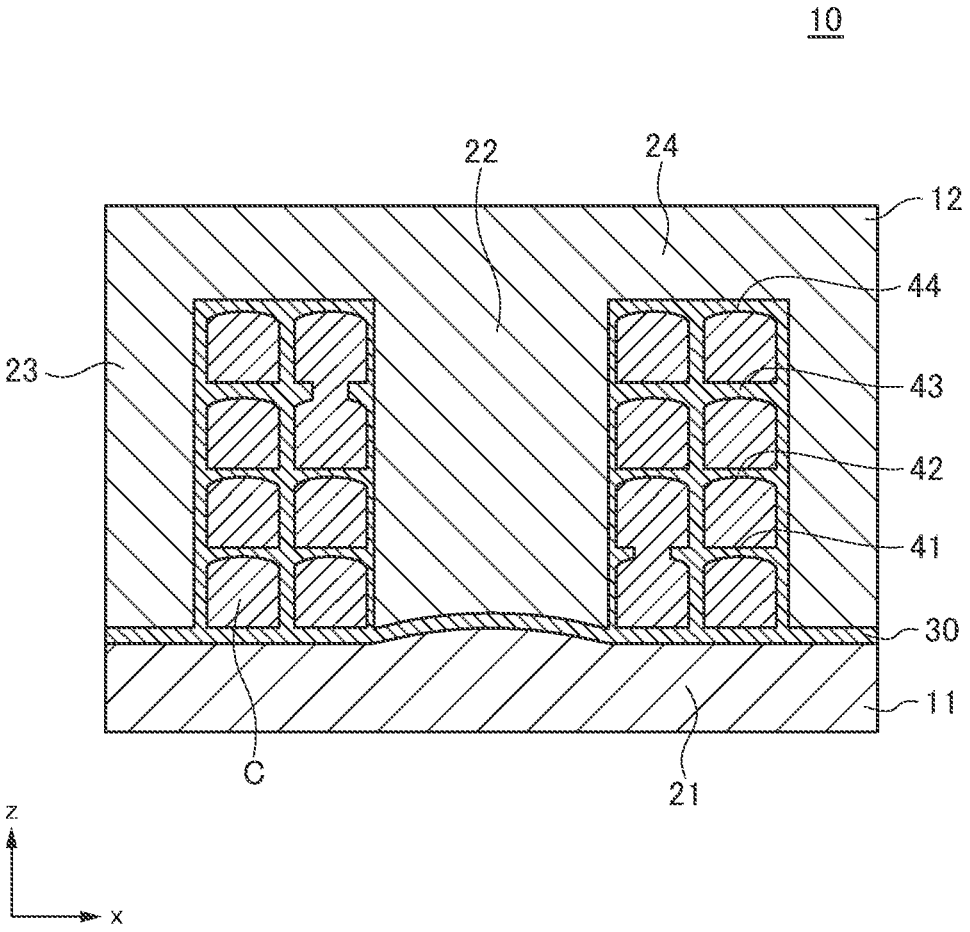
FIG. 2 is a cross-sectional view of the coil component 10.

FIG. 2 is a cross-sectional view of the coil component 10 according to the present embodiment.

As illustrated in FIG. 2, a coil pattern C made of a good conductor such as copper (Cu) is embedded in the first and second magnetic resin layers 11 and 12. In the present embodiment, the coil pattern C has a four-layer structure, and each layer has a spiral shape of two turns. As a result, the coil pattern C has eight turns in total. The surface of the coil pattern C is covered with an insulating gap layer 30 and interlayer insulating films 41 to 44, whereby the coil pattern C is prevented from contacting the first and second magnetic resin layers 11 and 12.

The first magnetic resin layer 11 is provided in a lower area 21 that covers the coil pattern C from one side in the coil axis direction (z-direction). On the other hand, the second magnetic resin layer 12 is provided in an inner diameter area 22 surrounded by the coil pattern C, an outer peripheral area 23 that surrounds the coil pattern C, and an upper area 24 that covers the coil pattern C from the other side in the coil axis direction. The insulating gap layer 30 is provided between the first and second magnetic resin layers 11 and 12.

Figure 8:
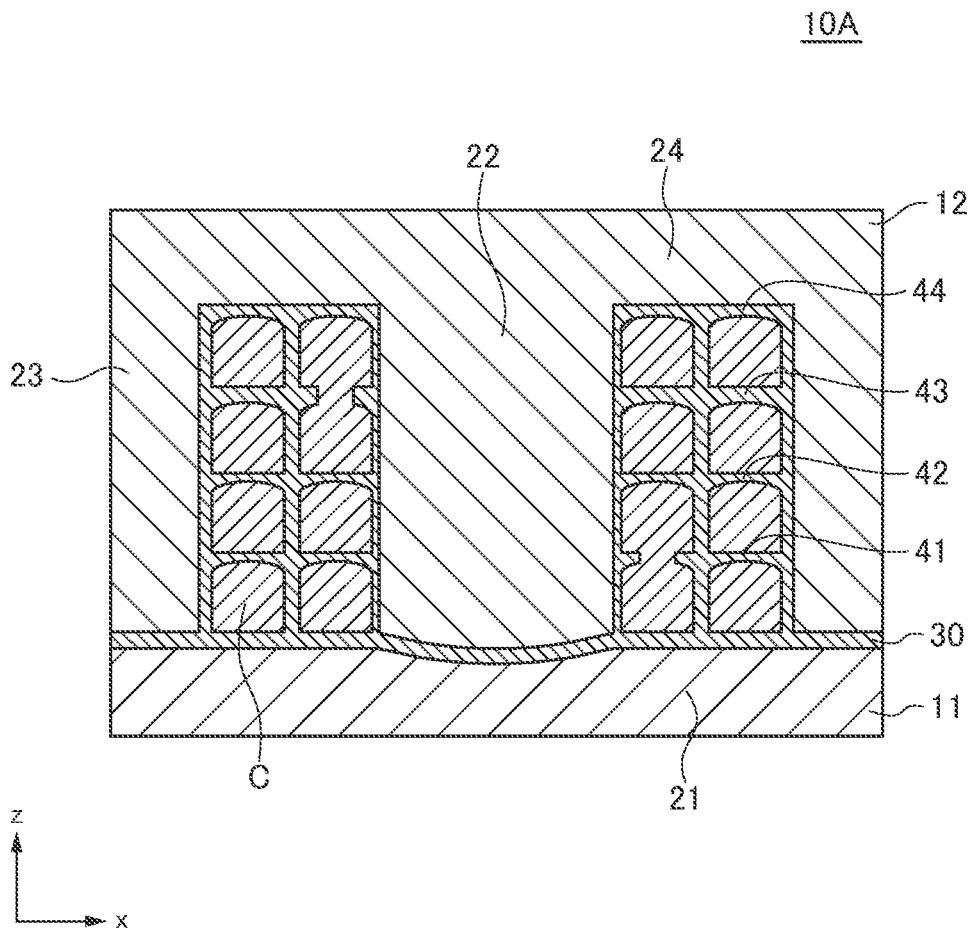
FIG. 8 is a cross-sectional view of the coil component 10A according to a modification.

The insulating gap layer 30 is made of a non-magnetic material such as resin and has a role of preventing magnetic saturation by forming a magnetic gap between the first and second magnetic resin layers 11 and 12. As illustrated in FIG. 2, the insulating gap layer 30 is curved in the axial direction at a part thereof positioned between the first magnetic resin layer 11 and a part of the second magnetic resin layer 12 that fills the inner diameter area 22. In the example of FIG. 2, the insulating gap layer 30 has a curved shape projecting upward, i.e., the second magnetic resin layer 12 side; however, it may have a curved shape projecting toward the first magnetic resin layer 11 side as in a coil component 10A according to a modification illustrated in FIG. 8.

As described above, in the coil component 10 according to the present embodiment, the insulating gap layer 30 has a curved shape, so that a contact area between the insulating gap layer 30 and the first and second magnetic resin layers 11 and 12 is increased as compared to the case where the insulating gap layer 30 is flat. Thus, adhesion between the insulating gap layer 30 and the first and second magnetic resin layers 11 and 12 is enhanced to improve product reliability.

Figure 9:
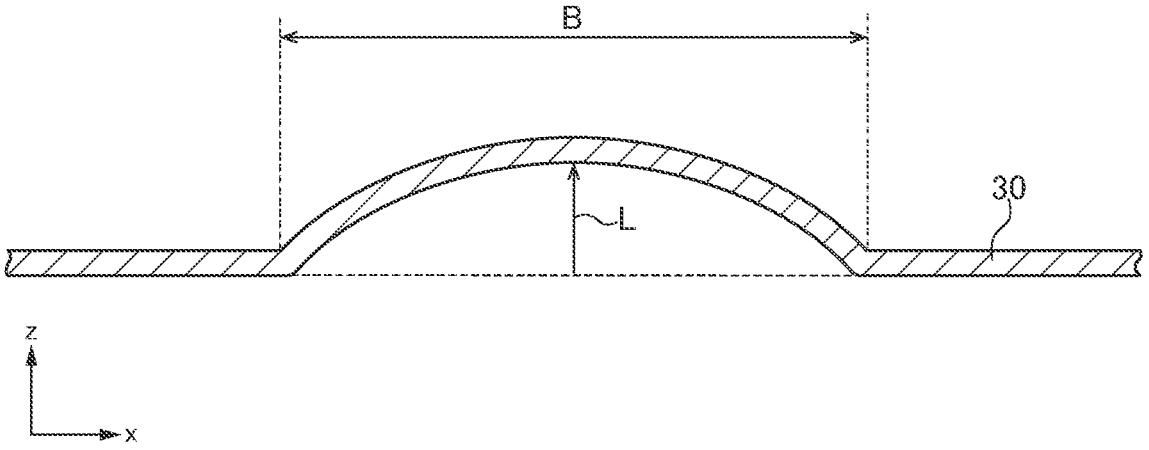
FIG. 9 is a schematic diagram for explaining a definition of a maximum displacement amount L.

There is no particular restriction on the amount of curve of the insulating gap layer 30; however, as illustrated in FIG. 9, assuming that the maximum displacement amount in the z-direction with respect to the flat part of the insulating gap layer 30 is L and that the diameter of the curved part of the insulating gap layer 30, that is, the diameter of the inner diameter area 22 of the second magnetic resin layer 12 is B, the value of L/B is preferably in the range of 0.001 to 0.5 and, more preferably in the range of 0.01 to 0.2. When $L/B<0.001$, an increase in the contact area between the insulating gap layer 30 and the first and second magnetic resin layers 11 and 12 is very small, and the effect of improvement in adhesion is hardly obtained; on the other hand, when L/B is $>0.5$, excessive stress is applied to the insulating gap layer 30, which may damage the insulating gap layer 30. In order to obtain a sufficient effect of improvement in adhesion without damaging the insulating gap layer 30, the value of L/B is preferably in the range of 0.001 to 0.5 and, when the value of L/B is set in the range of 0.01 to 0.2, it is possible to sufficiently obtain the effect of improvement in adhesion while sufficiently reducing the stress applied to the insulating gap layer 30.

Figure 10A:
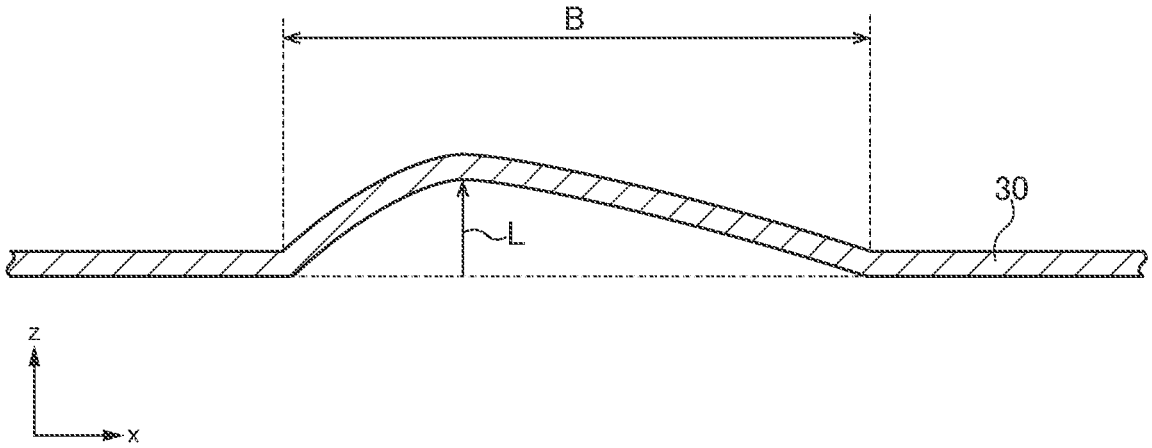
FIGS. 10A and 10B are schematic diagrams indicating examples that the displacement amount becomes maximum at a position offset from the center of the coil axis.
Figure 10B:
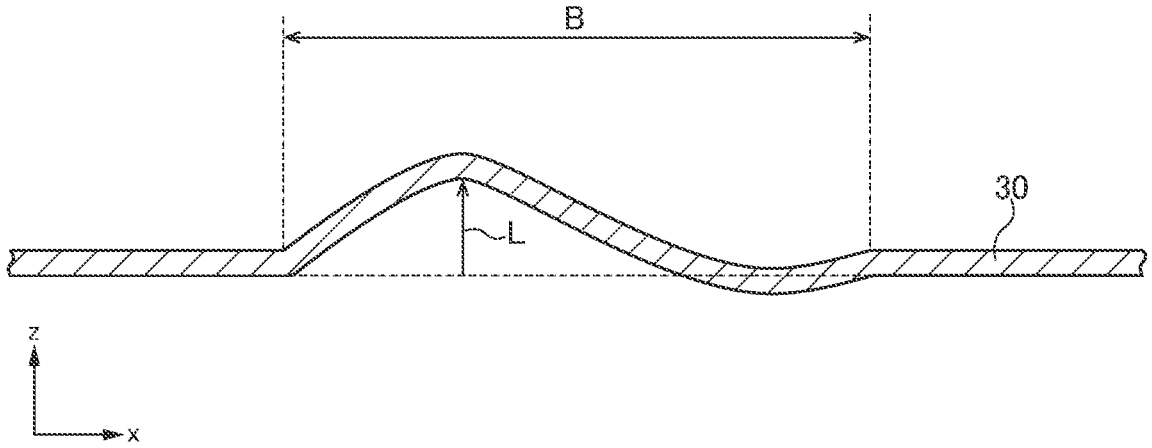

The position at which the displacement amount becomes maximum in the curve of the insulating gap layer 30 need not be the center of the coil axis, but the displacement amount may become maximum at a position offset from the center of the coil axis as illustrated in FIG. 10A. Further, as illustrated in FIG. 10B, the curved part of the insulating gap layer 30 may have both the convex portion and concave portion. In these cases, the displacement amount in the z-direction with respect to the flat part of the insulating gap layer 30 is defined as L.

Further, the coil component 10 according to the present embodiment does not use the magnetic substrate, unlike common coil components, but uses the first and second magnetic resin layers 11 and 12 to embed therein the coil pattern C, allowing the coil component 10 to have sufficient mechanical strength even when reduced in size. Further, the magnetic substrate is not used, so that the material cost can be reduced.

The following describes a manufacturing method for the coil component 10 according to the present embodiment.

FIGS. 3A to 7C are process views for explaining the manufacturing process of the coil component 10 according to the present embodiment.

Figure 3A:
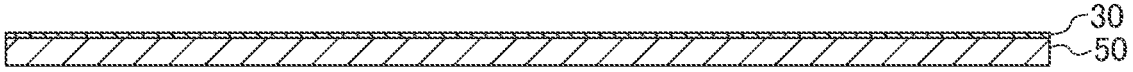
FIGS. 3A to 3C are process views for explaining the manufacturing process of the coil component 10.

As illustrated in FIG. 3A, a carrier plate 50 having a predetermined strength is prepared, and the insulating gap layer 30 is formed on the upper surface of the carrier plate 50. There is no particular restriction on the material of the carrier plate 50 as long as a predetermined mechanical strength can be ensured, and, for example, glass or ferrite can be used. Further, there is no restriction on a formation method for the insulating gap layer 30, and, for example, a resin material may be applied onto the surface of the carrier plate 50 by spin-coating or printing, or the insulating gap layer 30 already formed into a film may be bonded to the carrier plate 50.

Figure 3B:
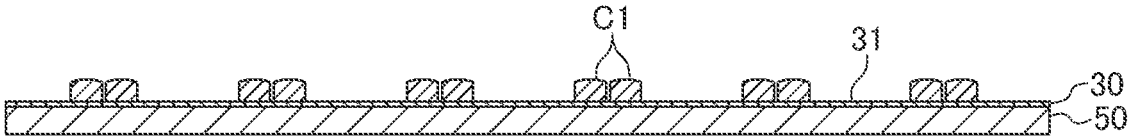

Subsequently, as illustrated in FIG. 3B, a first conductive layer C1 constituting the coil pattern C is formed on a surface 31 of the insulating gap layer 30. The conductive layer C1 is preferably formed by forming an underlying metal film using a thin-film process such as spattering and then by growing the underlying metal film to a desired thickness using an electrolytic plating method. The same applies to second to fourth conductive layers C2 to C4 to be formed later.

Figure 3C:
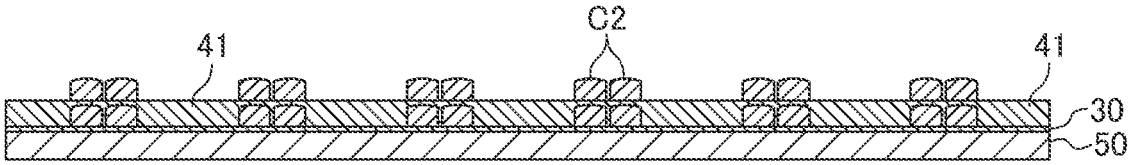
Figure 4A:
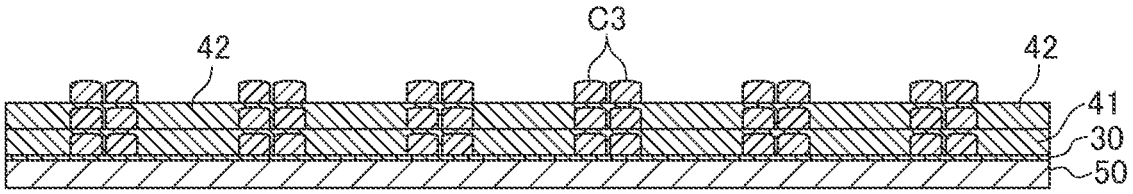
FIGS. 4A to 4C are process views for explaining the manufacturing process of the coil component 10.
Figure 4B:
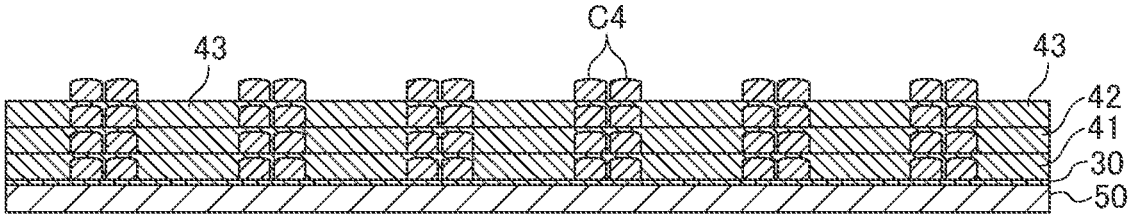
Figure 4C:
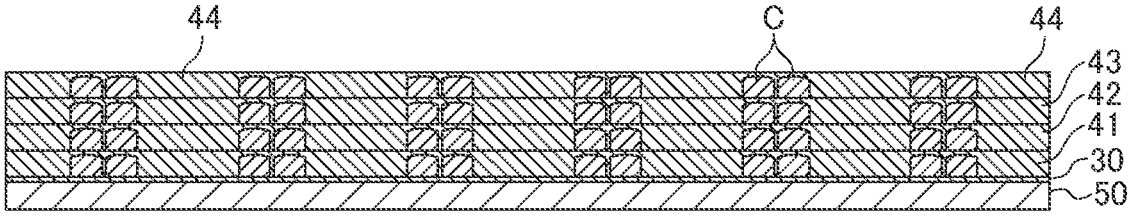

Subsequently, as illustrated in FIG. 3C, the interlayer insulating layer 41 covering the first conductive layer C1, and then a second conductive layer C2 is formed on the upper surface of the interlayer insulating layer 41. This process is repeated as illustrated in FIGS. 4A to 4C to alternately form the interlayer insulating layers 41 to 44 and the conductive layers C1 to C4 of the coil pattern C.

Figure 5A:
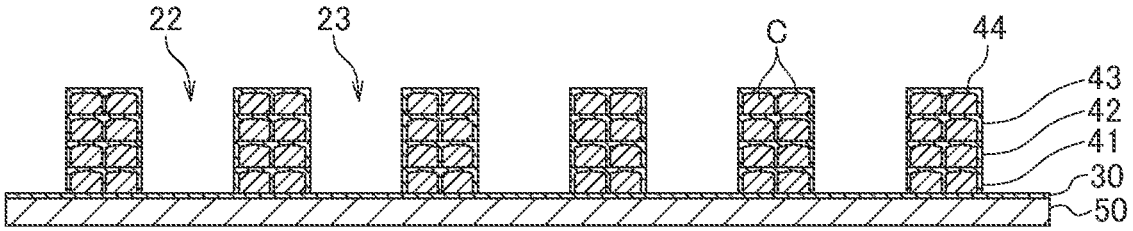
FIGS. 5A to 5C are process views for explaining the manufacturing process of the coil component 10.

Subsequently, as illustrated in FIG. 5A, milling or dry etching is performed to remove parts of the interlayer insulating layers 41 to 44 corresponding to the inner diameter area 22 and outer peripheral area 23 of the coil pattern C in a plan view. At this time, the insulating gap layer 30 is not removed. As a result, a space is formed in the inner diameter area 22 surrounded by the coil pattern C and the outer peripheral area 23 positioned outside the coil pattern C.

Figure 5B:
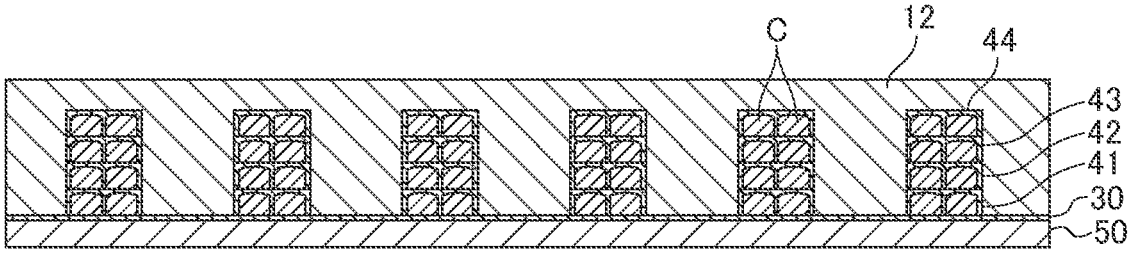

Subsequently, as illustrated in FIG. 5B, a semi-cured composite member made of resin containing ferrite powder or metal magnetic particles is embedded by printing in the space formed as a result of removal of the interlayer insulating layers 41 to 44. As a result, the second magnetic resin layer 12 is formed in the inner diameter area 22, the outer peripheral area 23, and the upper area 24. Alternatively, a method may be adopted in which a semi-cured second magnetic resin layer 12 is formed on the surface of another carrier plate, followed by pressing.

Figure 5C:
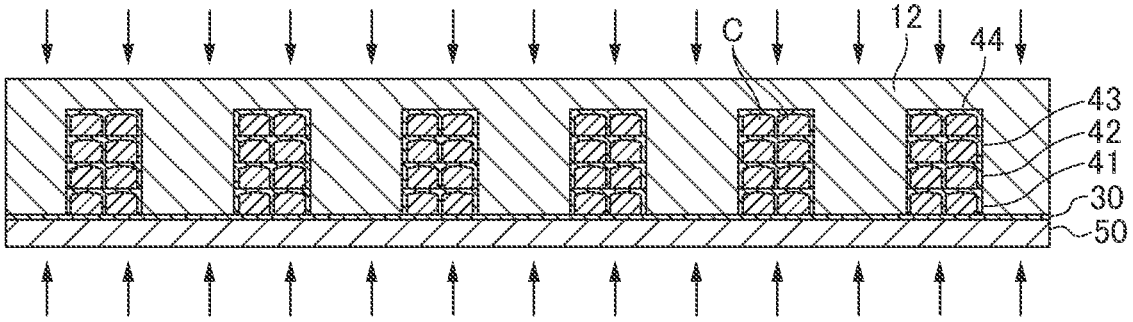

Subsequently, as illustrated in FIG. 5C, the second magnetic resin layer 12 is pressed to completely fill the gap generated in the inner diameter area 22 and outer peripheral area 23 with the second magnetic resin layer 12.

Figure 6A:
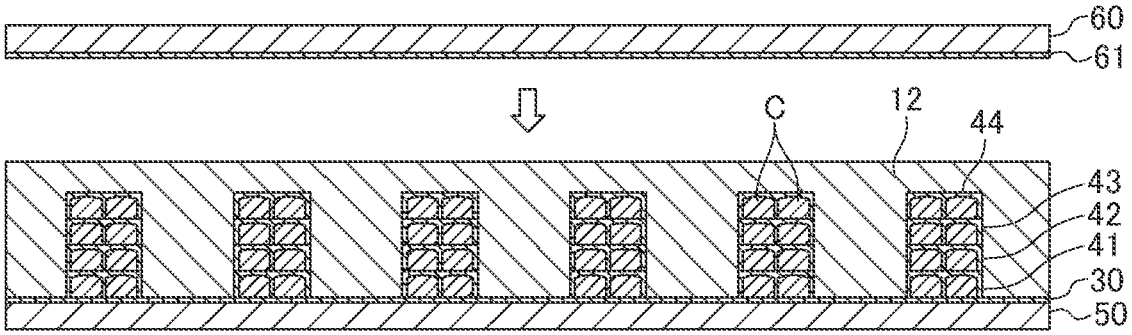
FIGS. 6A to 6C are process views for explaining the manufacturing process of the coil component 10.
Figure 6B:
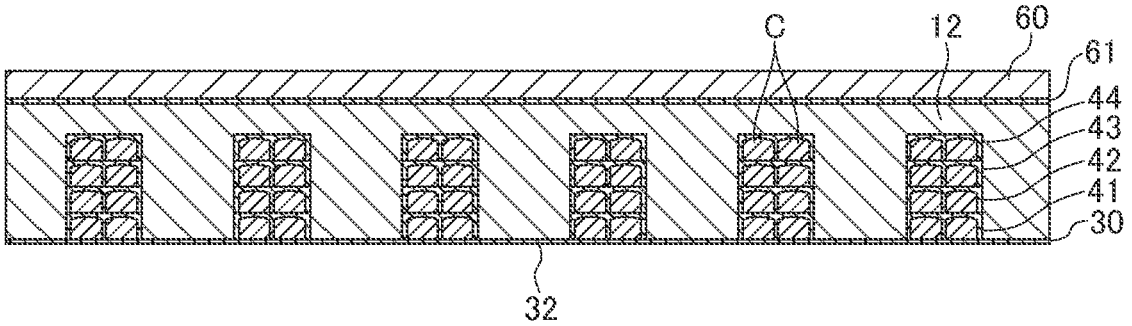

Subsequently, as illustrated in FIG. 6A, a support plate 60 is bonded to the second magnetic resin layer 12 through an adhesive 61, and the carrier plate 50 is peeled off as illustrated in FIG. 6B. The carrier plate 50 may be peeled off mechanically or by heating with laser irradiation. As a result, a back surface 32 of the insulating gap layer 30 is exposed.

The support plate 60 is a support member used for the peeling process of the carrier plate 50 and need not be used when there is no need to support the whole structure in the peeling process of the carrier plate 50.

Figure 6C:
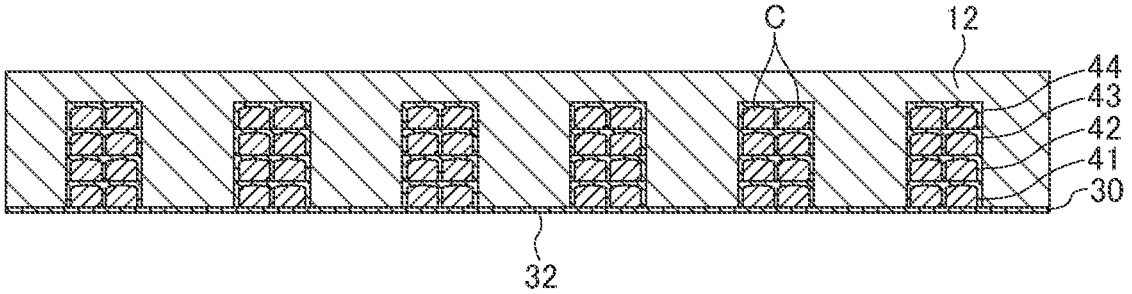
Figure 7A:
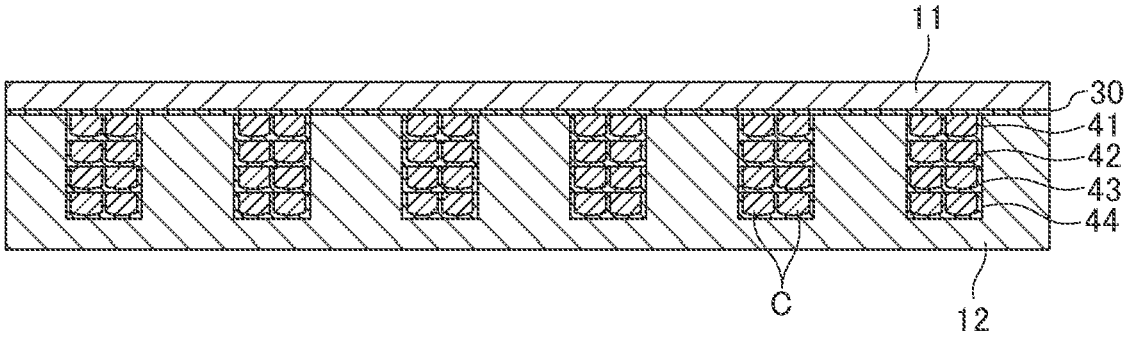
FIGS. 7A to 7C are process views for explaining the manufacturing process of the coil component 10.

Subsequently, the support plate 60 is peeled off as illustrated in FIG. 6C. Then, as illustrated in FIG. 7A, the resultant structure is turned upside down, and the first magnetic resin layer 11 is formed on the back surface 32 of the insulating gap layer 30. Like the second magnetic resin layer 12, the first magnetic resin layer 11 is preferably formed by embedding a semi-cured composite member made of resin containing ferrite powder or metal magnetic particles by printing. Alternatively, a method may be adopted in which a semi-cured first magnetic resin layer 11 is first formed on the surface of another carrier plate, followed by pressing.

Figure 7B:
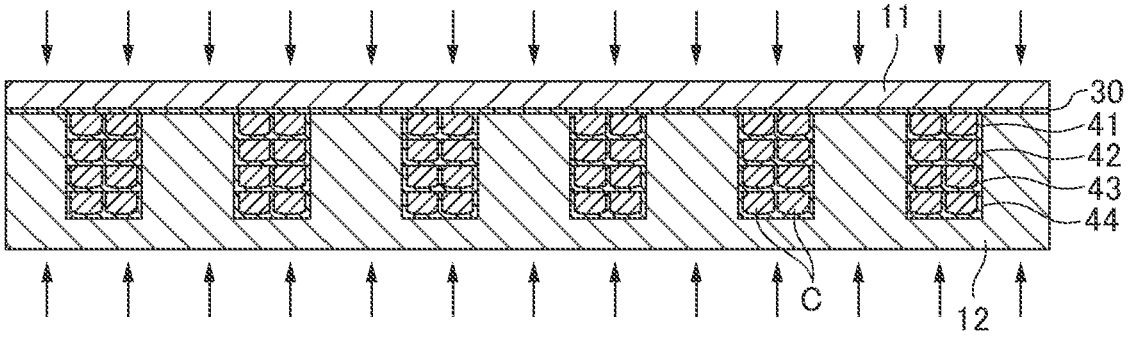

Subsequently, as illustrated in FIG. 7B, the first and second magnetic resin layers 11 and 12 are pressed to apply pressure thereto. At this time, the insulating gap layer 30 is deformed depending on the manner of applying pressure and, particularly, a part of the insulating gap layer 30 corresponding to the inner diameter area 22 of the coil pattern C in a plan view is curved in a convex or concave shape. When such a curve is generated, strong stress is applied to that part of the insulating gap layer 30 and then released, so that flexibility of the insulating gap layer 30 is increased at that part. Thus, even when some stress is applied to the coil component 10, the stress is absorbed by the curved part of the insulating gap layer 30, improving product reliability.

Further, the degree of curve of the insulating gap layer 30 is changed depending on the manner of applying pressure during pressing, so that the thickness of the curved part of the insulating gap layer 30 can be controlled by adjusting the degree of curve. Thereafter, heat or ultraviolet ray is applied to the semi-cured first and second magnetic resin layers 11 and 12 to completely cure them.

Figure 7C:
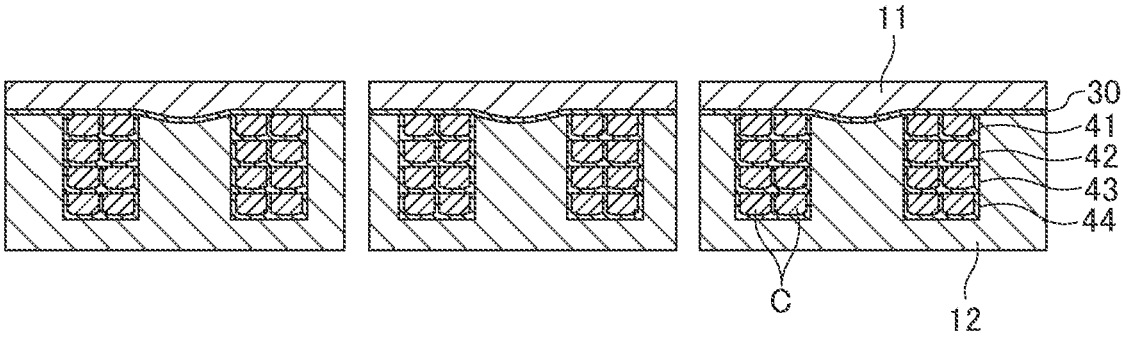

Subsequently, as illustrated in FIG. 7C, singulation is performed by dicing, and then the terminal electrodes E1 and E2 illustrated in FIG. 1 are formed, whereby the coil component 10 according to the present embodiment is completed.

As described above, according to the present embodiment, the semi-cured first and second magnetic resin layers 11 and 12 are pressed so as to curve the insulating gap layer 30 and cured in this state, so that it is possible to obtain the coil component 10 having the curved insulating gap layer 30. Thus, as described above, not only adhesion between the insulating gap layer 30 and the first and second magnetic resin layers 11 and 12 is enhanced, but also stress can be alleviated at the curved part of the insulating gap layer 30. As a result, a coil component having higher reliability than conventional coil components can be provided.

It is apparent that the present invention is not limited to the above embodiments, but may be modified and changed without departing from the scope and spirit of the invention.

For example, while the coil component according to the above embodiment has the coil pattern C having a spiral pattern with eight turns, the pattern shape of the coil pattern is not limited to this in the present invention.

REFERENCE SIGNS LIST

10, 10A coil component
11 first magnetic resin layer
12 second magnetic resin layer
21 lower area
22 inner diameter area
23 outer peripheral area

24 upper area
30 insulating gap layer
31 front surface of insulating gap layer
32 back surface of insulating gap layer
41-44 interlayer insulating layer
50 carrier plate
60 support plate
61 adhesive
C coil pattern
C1-C4 conductive layer
E1, E2 terminal electrode
S1 mounting surface
S2, S3 side surface

What is claimed is:

1. A coil component comprising:

a coil pattern;

a first magnetic resin layer provided in a lower area covering the coil pattern from one side in an axial direction;

a second magnetic resin layer provided in an inner diameter area surrounded by the coil pattern, an outer peripheral area that surrounds the coil pattern, and an upper area that covers the coil pattern from other side in the axial direction; and an insulating gap layer provided between the first and second magnetic resin layers, wherein a part of the insulating gap layer that is positioned between the first magnetic resin layer and a part of the second magnetic resin layer that is positioned in the inner diameter area is curved in the axial direction.

2. The coil component as claimed in claim 1, wherein the first and second magnetic resin layers are made of a same material.

3. The coil component as claimed in claim 1, wherein, assuming that a maximum displacement amount in the axial direction with respect to a flat part of the insulating gap layer is L and that a diameter of the inner diameter area of the second magnetic resin layer is B, a value of L/B is in a range of 0.001 to 0.5.

4. The coil component as claimed in claim 3, wherein a value of L/B is in a range of 0.01 to 0.2.

5. A method for manufacturing a coil component, the method comprising:

forming a coil pattern on a front surface of an insulating gap layer supported by a carrier plate;

forming a second magnetic resin layer in an inner diameter area surrounded by the coil pattern, an outer peripheral area that surrounds the coil pattern, and an upper area that covers the coil pattern from one side in an axial direction;

forming a first magnetic resin layer on a back surface of the insulting gap layer after peeling off the carrier plate; and pressing the first and second magnetic resin layers to curve, in the axial direction, a part of the insulating gap layer that is positioned between the first magnetic resin layer and a part of the second magnetic resin layer that is positioned in the inner diameter area.

6. The method for manufacturing a coil component as claimed in claim 5, wherein the forming the second magnetic resin layers is performed by applying a semi-cured magnetic resin material.

7. The method for manufacturing a coil component as claimed in claim 5, wherein the forming the first magnetic resin layers is performed by applying a semi-cured magnetic resin material.

* * * * *